US005516994A

United States Patent [19]

Lay

[11] Patent Number: 5,516,994

[45] Date of Patent: May 14, 1996

[54] ALARM CONTINUITY SWITCH

[76] Inventor: Brian Lay, P.O. Box 117, Georgetown, Tex. 78626

[21] Appl. No.: 363,933

[22] Filed: Dec. 27, 1994

[51] Int. Cl.[6] ..... H01H 3/16

[52] U.S. Cl. ..... 200/61.71; 200/61.81; 200/61.93

[58] Field of Search ..... 200/61.62, 61.71–61.75, 200/61.76, 61.8, 61.81, 61.82, 61.93, 61.08, 276–277.1; 340/540, 541, 545, 546, 548, 549, 565, 568, 590, 652, 686, 687

[56] References Cited

U.S. PATENT DOCUMENTS

| | | | |
|---|---|---|---|
| 3,775,575 | 11/1973 | Parlato et al. | 200/61.71 |
| 3,909,331 | 9/1975 | Cohen | 200/61.62 X |
| 4,151,382 | 4/1979 | Kaufman et al. | 200/61.81 X |
| 4,392,707 | 7/1983 | Holce et al. | 200/61.71 X |
| 4,511,771 | 4/1985 | Rossell | 200/61.75 X |
| 4,556,765 | 12/1985 | Shaw et al. | 200/61.71 |
| 4,707,575 | 11/1987 | Krasik | 200/276 |

*Primary Examiner*—J. R. Scott
*Attorney, Agent, or Firm*—Malloy & Malloy

[57] ABSTRACT

To be utilized with a conventional structural alarm system having a plurality of alarm wires which carry a constant current flow, an alarm continuity switch which includes at least two identical contact assemblies, each of which have a contact housing. Included as part of the contact housing is a front main face wherein a generally narrow vertical channel with a first contact extending therefrom is disposed, and a generally wide mouth recess having a second contact therein is disposed. The first and second contacts are positioned such that they will slidingly engage with opposing contacts of a confronting contact assembly, the first contact of one assembly engaging the second contact of a second assembly, and vice versa. Further, the contact housing, which is secured to the structure, will include first and second wire terminals, each respectively secured to the first and second contacts and adapted to maintain the constant current flow through the alarm wires.

14 Claims, 2 Drawing Sheets

ALARM CONTINUITY SWITCH

BACKGROUND OF THE INVENTION

1. Field of the Invention

The present invention relates to an alarm continuity switch to be used with a structure alarm system, the continuity switch being substantially easy to install and secure in place, substantially inexpensive to implement and manufacture, and conveniently and effectively utilized in a variety of locations and orientations without adaptation.

2. Description of the Related Art

Generally in the field of structure alarms, such as those used in homes and office structures, alarm contacts are utilized at the various structural openings, such as windows and doors. Generally, these alarms function by directing a constant current through a plurality of alarm wires, and through confronting contacts of a continuity switch, such that when the window or other structural closure is opened, the contacts of the continuity switch will separate breaking the continuous current flow and signalling the alarm.

Presently in the art, the primary types of continuity switches which are employed include magnetic switches, which need not actually touch one another, and contact switches which must remain in connected relation with one another in order to enable the current to continuously flow. Regarding the magnetic switches, a magnet in at least one of a pair of confronting contacts will maintain metallic portions within the opposing contact in a current flowing orientation. These switches, however, can be difficult to employ and utilize, and because they do not function with the certainty of physical contact switches, are generally not preferred for installation. Accordingly, physical contact switches are generally utilized to provide the current continuity. In particular, conventionally known and implemented switch assemblies include male and female contacts which are to be disposed in confronting relation from one another on the window. Because of their structural configurations, these types of male and female switches cannot slide over one another in order to initiate the necessary contact, but rather must be pushed together and pulled apart in order to ensure appropriate functioning.

Generally, the physical contact switches will be secured along a lower edge of the window and along the sill or bottom window frame portion. In many cases, however, this necessary positioning can be considerably unattractive and difficult to implement. Specifically, when utilizing the conventional contact switches positioned at a lower edge of the window, extensive wiring is required to reach the necessary location for connection. Also, in such circumstances, stretch cords are usually required so as to enable the wire to stretch and contract as the window is opened and closed. Further, in the case of these conventional contacts, placement at the sill portion of the window can often be quite unattractive, conspicuous, and can remain inconveniently in the way when the window is open. Also, most new styles of single hung windows include a lip at a lower edge of the window from which the window is lifted for opening. Because this lip extends along an entire width of the window and usually abuts the window frame, positioning of the connectors can be quite inconvenient if even possible, therefore causing most installers to turn to the magnetic contacts.

In addition to the aesthetic and logistical difficulties involved when using conventional switches, the need for a specific male and female switching component as well as the number of screws required to properly secure the switch, can make installation quite difficult and time-consuming. All of these factors will not only increase installation costs, but will also increase the cost of the parts themselves due to the number of specific components required to assemble one complete switch. Further, the use of a large number of screws can be quite unattractive.

Still another drawback associated with conventionally known switching assemblies includes their rapid ware and difficult adaptability. Specifically, because of the manner in which the contacts abut one another from confronting positions, after repeated contact at the same spot along the surface of the generally thin metal contact, the surface of the thin female contact will wear through requiring that the switch component be replaced. Also, because of the precise contact positioning required, if the male and female switch components must be positioned on uneven surfaces, a plurality of spacers will generally be required in order to maintain precise, confronting positioning.

Accordingly, there is a significant need in the art for a simple to install, highly effective alarm continuity switch which can provide the same effective results of conventional switches, while being adaptable for positioning in a variety of locations and on a variety of surface configurations, including even and uneven surfaces utilizing a minimum number of parts and requiring no adaptation of the components with additional articles such as stretch cords or spacers.

SUMMARY OF THE INVENTION

The present invention is directed to an alarm continuity switch which will be used with a conventional structure alarm system in a home office or other building structure. Specifically, the conventional structure alarm system will be of the type which has a plurality of alarm wires which carry a constant current flow when the alarm system is armed and in a ready mode. The alarm continuity switch is utilized to maintain that continuous current flow and when triggered, discontinue the current flow so as to signal the alarm system that an improper entry is being attempted. Included as part of the alarm continuity switch are at least two identical contact assemblies. Each of the contact assemblies is alike and interchangeable, and will include a contact housing. Specifically, the contact housing will include a front main face, a rear face, and a number of side faces. Included on the front main face, which includes a top edge, a bottom edge, and a pair of opposite side edges, is a generally narrow, vertical channel which extends from the top edge to the bottom edge of the front main face. Also included in the front main face is a generally wide mouthed recess. This wide mouth recess includes an open top and bottom edge corresponding the top and bottom edges of the front main face.

Extending from the vertical channel is a first contact. Further, disposed within the wide-mouthed recess is a second contact. The second contact is positioned within the wide-mouthed recess such that it will extend substantially across the wide-mouthed recess. In order to achieve proper functioning, a first and a second contact assemblies are mounted and disposed in adjacent, confronting relation with one another. Further, the second contact of the first of the contact assemblies is positioned to slide into current flowing contact with the first contact of the second of the contact assemblies. That contact will occur simultaneously with the first contact of the first contact assembly sliding into current flowing contact with the second contact of the second contact assembly.

Also disposed in the contact housing, so as to be exteriorly accessible, are a first wire terminal and a second wire terminal. These wire terminals are positioned so as to enable the alarm wires to be connected in current flowing contact thereto, with the first wire terminal being connected with the first contact and the second wire terminal being connected with the second contact.

Finally, fastening means are included to secure the contact housing to a corresponding surface of the structure to be secured by the alarm system.

It is an object of the present invention to provide an alarm continuity switch which includes and incorporates a number of like parts, thereby minimizing the time and expense of manufacturing the components of the alarm system while also reducing the time and cost associated with installation and/or repair of the alarm system.

Still another object of the present invention is to provide an alarm continuity switch which is capable of being disposed in a plurality of orientations and locations about the perimeter of a structural opening to be secured.

A further object of the present invention is to provide an alarm continuity switch capable of being disposed along a side edge of a window to be secured, thereby minimizing the wiring required and enabling the switch to be inconspicuous and concealable.

A further object of the present invention is to provide an alarm continuity switch which can be utilized with single hung windows of the type including a gripping lip extending across an entire width of the window.

Yet another object of the present invention is to provide an alarm continuity switch which can be easily positioned and installed utilizing only a single screw for each contact assembly.

Another object of the present invention is to provide an alarm continuity switch which can be easily and effectively secured in an operable orientation on uneven surfaces without requiring the use of spacers.

An additional object of the present invention is to provide an alarm continuity switch which provides an increased contact wear surface and is conventionally utilized so as to substantially increase the effective life of the alarm continuity switch.

Yet another object of the present invention is to provide an alarm continuity switch which is structured for use with conventional structural arm systems and which is capable of incorporating various additional detectors such as foil-type glass breaking detectors or sonic detectors.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
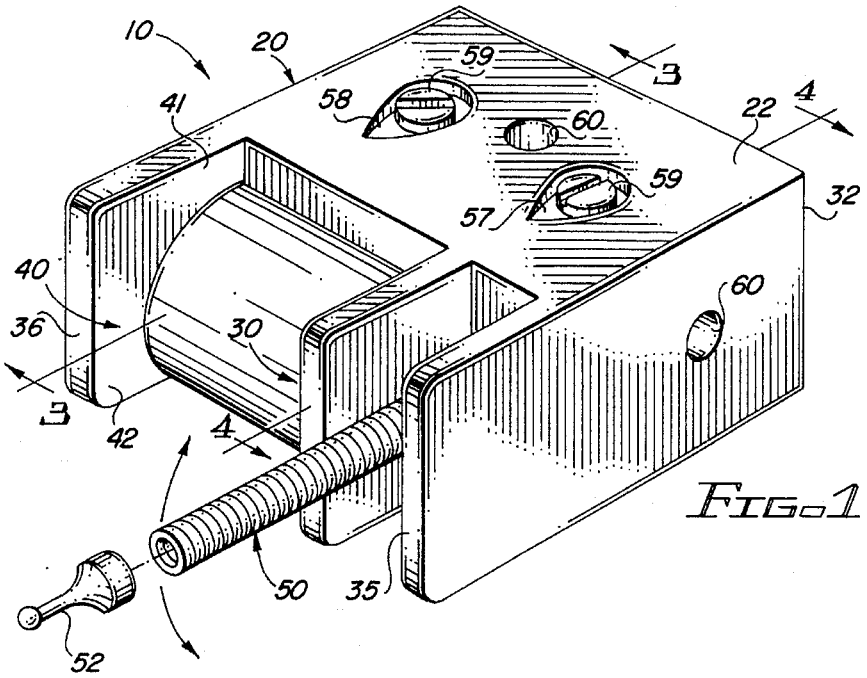
FIG. 1 is a perspective view of the switch of the present invention.

Shown throughout the drawings, the present invention is directed towards an alarm continuity switch, generally indicated as 10. The alarm continuity switch 10 is structured to be utilized with a conventional structure alarm system, such as those utilized in homes and businesses, at various structural closures 80 such as a window, sliding glass door, or conventional door. In particular, these alarms are generally of the type which include a plurality of alarm wires 65 extending to the numerous structural closures throughout the house. Through these alarm wires 65, a constant current will flow when the alarm is armed and in a ready mode. However, when contact is broken at an alarm switch 10, the constant current flow is interrupted causing the alarm system to signal a warning.

The alarm continuity switch 10 will preferably include two identical contact assemblies 15. Because the individual contact assemblies 15 are identical to one another, they can be interchangeably used eliminating the cost of molding male and female components, and minimizing the time required for an installer to obtain the necessary contact assembly 15 required in a particular location. Each of the contact assemblies 15 will include a contact housing 20. The contact housing 20, will preferably have a cube-type shape and will be formed of molded plastic. Defining the contact housing 20 are a plurality of side faces 22, 24, 26, 28, a front main face 30 and a rear face 32. As to the front main face 30, it will include a top edge 33, a bottom edge 34, and a pair of opposite side edges 35 and 36.

Disposed within the front main face 30 will be a generally narrow vertical channel 38. This vertical channel will preferably extend from the top edge 33 to the bottom edge 34 of the front main face 30, and will also preferably, but not necessarily, be recessed within the front main face 30. Also disposed within the front main face 30, in a position adjacent the vertical channel 38, is a generally wide-mouthed recess 40. This generally wide-mouthed recess 40 will take up a substantial portion of the front main face 30, as compared with the vertical channel 38, and will also have an at least partially open top edge 41 as well as an at least partially open bottom edge 42 corresponding the top and bottom edges 33 and 34 of the front main face 30.

Located within the vertical channel 38, and extending from an interior of the contact housing 20 at the vertical channel 38, is a first contact 50. This first contact 50 will preferably be in the form an elongate rod which protrudes from the contact housing 20. Further, this first contact 50 will also preferably be pivotally biased in the vertical channel 38 such that it may pivot towards the top and bottom edges 33 and 34 of the front main face 30. The first contact 50 can be pivotally biased either by securing to a pivot joint, such as a ball joint at the front main face 30, or as in the preferred embodiment, the first contact 50 may be a coiled spring which is normally flexible. Additionally, a contact tip 52 may be disposed on the end of the first contact 50 to further facilitate current flowing contact by this first contact 50.

Included within the wide-mouth recess 40 is a second contact 45. This second contact 45 will preferably have a generally U-shaped, arched configuration and will extend substantially across the wide-mouthed recess 40 so as to ensure contact therewith within the wide-mouthed recess 40.

When in use, a first and a second contact assemblies 15' and 15" will be positioned in generally confronting relation with one another, such as along an edge of a window 84 and its frame 82. Specifically, the first of the contact assemblies 15' will be placed on the window itself such that the front main face 30 extends toward the frame 82 of the window. Further, although the assembly 15' will probably be positioned along vertical edges of the window 84, for different types of structural closures, such as conventional doors or sliding glass doors, alternative edges will probably be utilized for positioning of the first contact assembly 15'. In use, the second of the contact assemblies 15" will be placed upon the frame 82 such that the front main face 30 of the second contact assembly 15" will be disposed in confronting relation with the front main face 30 of the first contact assembly 15'. In particular, the first and second contact assemblies 15' and 15" will be oriented such that they will move relative to one another along the axis of the top and bottom edges 33 and 34 of their front main faces 30. More importantly, the assemblies 15' and 15" are positioned such that the first contact 50 of the first contact assembly 15', upon corresponding slided movement of the structural closure 80 towards the second contact assembly 15", will slide into the wide-mouth recess 40 of the second contact assembly 15" resulting in current flowing contact between the first contact 50 of the first contact assembly 15' and the second contact 45 of the second contact assembly 15". Also, simultaneously, the second contact 45 of the first contact assembly 15' will slide down into current flowing contact with the first contact 50 of the second contact assembly 15". It should be recognized that this particular configuration is adapted for use with conventional vertically opening windows such as the commonly utilized single hung windows. Secured positioning of the various contact assemblies 15 may, however, be varied depending upon the type of structural closure 80 on which the switch 10 is utilized. For example, on a sliding glass door, the first contact assembly 15' will preferably be disposed on an upper or lower edge of the sliding glass door, still with the front main face 30 extending away from the sliding glass door towards its frame, and with the second contact assembly 15" being positioned in confronting relation on the frame of the sliding in confronting relation on the frame to enable the slided contacting engagement between the respective first and second contacts.

Also disposed within the contact housing 20, and exteriorly accessible, preferably through one of the various side faces 22, 24, 26, 28 of the contact housing 20, are a first and a second wire terminal 55 and 56. These first and second wire terminals 55 and 56 will preferably be positioned within tear-dropped shaped recesses 57 and 58 which will facilitate exterior connection thereto by a wire. In particular, the first and second wire terminals 55 and 56 will include a screw 59 or like current transmitting member such as a small piece of wire, a rivet, or a like metallic conduit. These screws 59 will extend into the contact housing 20 through the tear-dropped shaped recesses 57 and 58 until they come into contact with the first and second contacts 50 and 45 within the contact housing 20. In particular, the first and second contacts 50 and 45 will preferably extend into the contact housing 20, either through an integral extension or other current flowing conduit connected thereto, such that the first contact 50 will be in electrical communication with the first wire terminal 55 and the second contact 45 will be in electrical flowing communication with the second wire terminal 56.

In use, the alarm wires 65 will be secured to the second contact assembly 15" at the first and second wire terminals 55 and 56, with current flowing in through one of the wire terminals and flowing out from another of the wire terminals. Further, the first and second wire terminals 55 and 56 of the first contact assembly 15' disposed on the structural closure 80 will be electrically interconnected with one another by connection means which will maintain current flow therebetween when the alarm system is armed and in the ready mode. The connection means can include a small wire or electrically conductive segment extending from the first wire terminal 55 of the first contact assembly 15' to the second wire terminal 56 of the first contact assembly 15'. Accordingly, when the alarm is on and in its ready mode, current will flow in through one of the wire terminals of the second contact assembly 15", passing through one of its contacts to the corresponding contact of the first contact assembly 15'. From there, the current will flow between the wire terminals of the first contact assembly 15', out through the alternate contact thereof into a corresponding contact of the second contact assembly 15", and exit to the alarm wires 65. Accordingly, when the first and second contact assemblies 15' and 15" are separated from one another, the continuing current flow is interrupted. In addition to merely utilizing a small segment of wire as the connection means, alternative, conventional structural alarm features such as breakage detection means can be included. Specifically, the conventionally employed foil strip disposed about a perimeter of a main surface of the window 84 can be utilized within the connection means which maintain constant current flow between the wire terminals 55 and 56 of the first contact assembly 15'.

Figure 2:
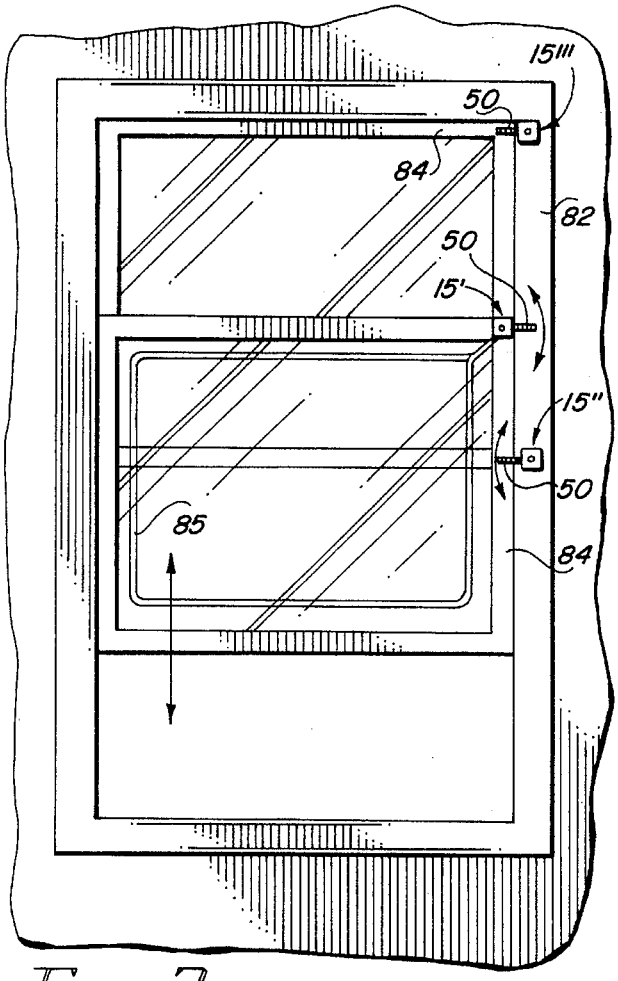
FIG. 2 is a front view of a switch of the present invention in operational positioning at a structural closure.
Figure 3:
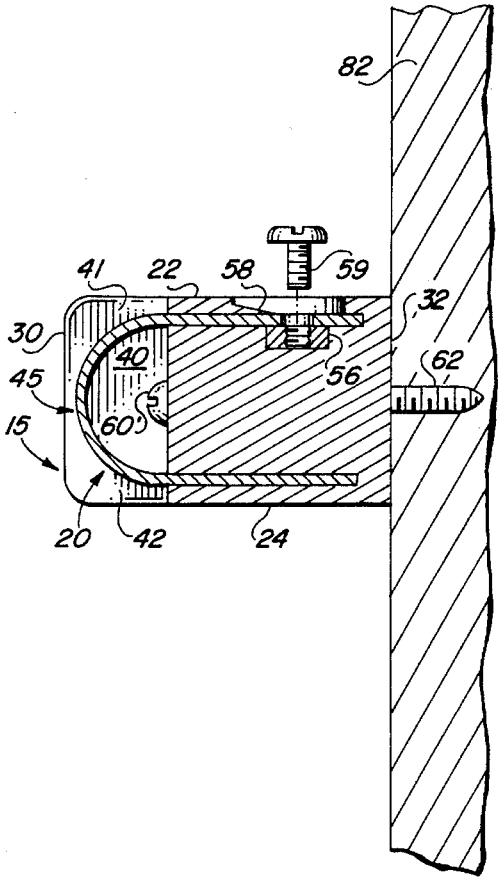
FIG. 3 is a cross-sectional view along line 3—3 of FIG. 1.
Figure 4:
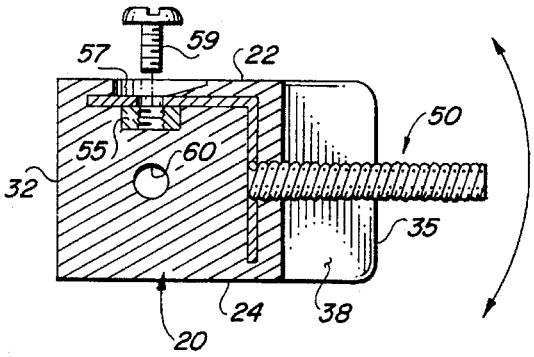
FIG. 4 is a cross-sectional view along line 4—4 of FIG. 1.

In an alternative embodiment, a third contact assembly 15''' will also be included. As illustrated in FIG. 2, this third contact assembly 15''' can be positioned along the frame 82 in a window open position. Specifically, when the window 84 is in its closed position, alarm continuity is maintained between the first and the second contact assemblies 15' and 15". When, however, a user desires to arm and utilize the alarm while maintaining the window in an open, ventilating position, the third contact assembly 15''' and the first contact assembly 15' will maintain the continuous current flow.

In order to secure the respective contact assemblies 15 in place, fastener means are employed. These fastener means, which can be any suitable fastener such as an adhesive, hanging or surface penetrating fastener, will preferably be in the form of a single screw 62. Accordingly, disposed within the contact housing 20 is at least one, but preferably a plurality of fastener passages 60. Because of the variety of configurations in which the individual contact assemblies 15 can be mounted, the fastener passages 60 will preferably include vertical and horizontal fastener passages extending from opposing side faces, and a transverse fastener passage 60' extending from the front main face 30 to the rear face 32. In all cases, the fastener passage 60 will extend completely through the contact housing 20 so as to enable a single elongate screw 62 to extend therethrough into secured engagement with the structural portion to which the contact assembly 15 is being secured. In the case of the transverse fastener passage 60', an opening in the front main face 30 will be concealed behind the second contact 45. In such a case, the second contact 45 is removable during fastening, and can be reinserted subsequent to secured passage of the screw 62 into the concealed opening 60'. Further, the fastener passage 60, which is preferably sized to correspond the dimension of the screw, can also include an elongate slot so as to allow adjustable positioning of the screw at any position along a length of the slot. Such a slot can either be built in or be included in a replaceable rear portion of the housing.

Figure 5:
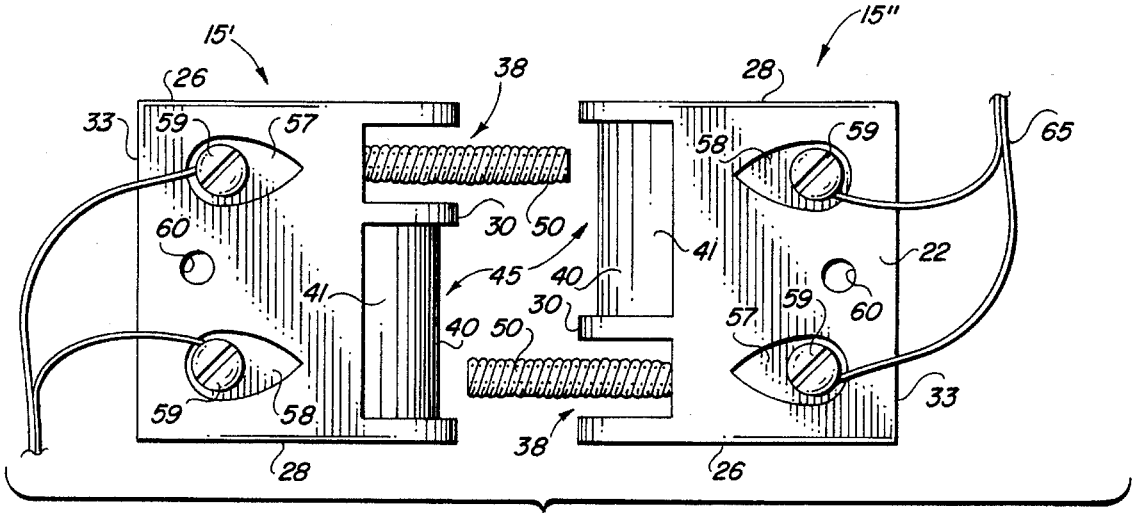
FIG. 5 is a top view of the switch of the present invention.
Figure 6A:
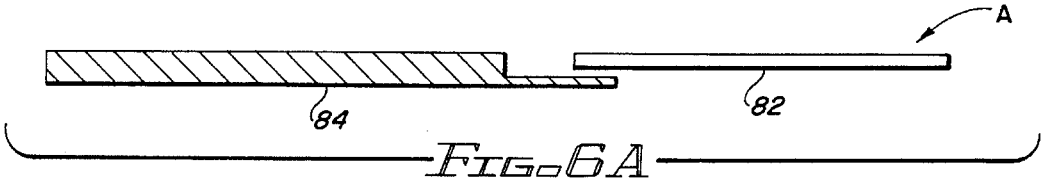
FIG. 6A is a top cross-sectional view of a conventional positioning of a window edge relative to the window frame.
Figure 6B:
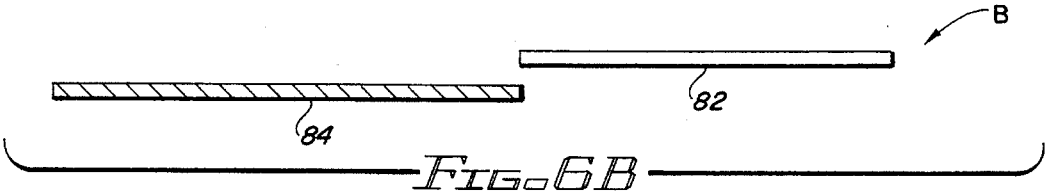
FIG. 6B is a top cross-sectional view of an alternative embodiment positioning of a window edge relative to the window frame.

Turning to FIG. 5, it is noted that confronting contact assemblies 15' and 15" need no adaptation if they are placed on generally uneven confronting surfaces, such as that shown at B of FIG. 6B. Although most confronting surfaces, as at A of FIG. 6A, provide only a gradual step, some window structures can provide more significant steps, as at B. Utilizing the present invention, because of the width of the wide-mouthed recess 40 and second contact 45 disposed therein, lateral movement due to uneven surfaces will not prevent appropriate contacting movement of the generally narrow first contacts 50 into the wide-mouthed recesses 40. This will therefore eliminate the need for any spacers or additional adaptation.

Now that the invention has been described,

What is claimed is:

1. To be used with a conventional structure alarm system having a plurality of alarm wires structured to carry a constant current flow upon the alarm system being armed and in a ready mode, an alarm continuity switch comprising:

at least two identical contact assemblies, each of said contact assemblies including a contact housing, said contact housing including a front main face, a rear face, and a plurality of side faces, said front main face including a top edge, a bottom edge, and a pair of opposite side edges, a generally narrow vertical channel disposed in said front main face and extending from said top edge to said bottom edge, a first contact, said first contact being generally elongate and extending from said housing at said vertical channel, a generally wide mouthed recess disposed in said front main face, said wide mouthed recess having an at least partially open top edge and at an at least partially open bottom edge and corresponding said top and said bottom edges of said front main face, a second contact, said second contact being disposed in said wide mouthed recess and extending substantially across said wide mouthed recess, said second contact of a first of said contact assemblies being structured and disposed to slide into current flowing contact with said first contact of a second of said contact assemblies, simultaneously with said first contact of said first of said contact assemblies sliding into current flowing contact with said second contact of said second of said contact assemblies, upon said first and said second contact assemblies being disposed in adjacent, confronting relation with one another, a first wire terminal and a second wire terminal disposed in said contact housing and being exteriorly accessible so as to facilitate connection of the alarm wires thereto, said first wire terminal being connected in current flowing communication with said first contact, said second wire terminal being connected in current flowing communication with said second contact, and fastening means structured and disposed to secure said contact housing to corresponding surfaces of a structure to be secured by the alarm system.

2. An alarm continuity switch as recited in claim 1 wherein said fastening means includes an elongate fastener member structured to extend through said contact housing into the corresponding surface of the structure thereby securing the contact housing to the structure.

3. An alarm continuity switch as recited in claim 2 wherein said contact housing includes a fastener passage extending therethrough between opposite ones of said side faces of said contact housing, said fastener passage being structured and disposed for passage of said single screw therethrough to secure said contact housing to the corresponding surface of the structure.

4. An alarm continuity switch as recited in claim 2 wherein said contact housing includes a fastener passage extending therethrough from said wide mouth recess of said front main face to said rear face, said fastener passage being structured and disposed for passage of said single screw therethrough to secure said contact housing to the corresponding surface of the structure.

5. An alarm continuity switch as recited in claim 4 wherein said fastener passage is concealed behind said second contact.

6. An alarm continuity switch as recited in claim 5 wherein said second contact is removably disposed in said wide mouth recess so as to facilitate passage of said single screw through said fastener passage.

7. An alarm continuity switch as recited in claim 1 wherein said second of said contact assemblies is secured to a stationary frame edge of a closure frame of the structure, and said first of said contact assemblies is secured to an edge of a closure member of the structure, the closure member being structured to move between an open position and a closed position within the closure frame, said first and said second contact assemblies being disposed in confronting constant current flowing orientation with one another upon the closure member being in the closed position.

8. An alarm continuity switch as recited in claim 1 wherein said second of said contact assemblies is secured to the alarm wires at said first and said second wire terminals thereof,

9. An alarm continuity switch as recited in claim 8 wherein said first and said second wire terminals of said first of said contact assemblies are connected with one another through connection means structured and disposed to maintain current flow therebetween upon the alarm system being armed and in the ready mode.

10. An alarm continuity switch as recited in claim 9 wherein said connection means includes breakage detection means structured and disposed to detect a breakage of a main surface of a closure member of the structure.

11. An alarm continuity switch as recited in claim 1 wherein said top and bottom edges of said wide mouthed recess are substantially wide so as to facilitate sliding entry of a confronting one of said first contacts therein into contacting relation with said second contact in said wide mouthed recess upon said first one of said contact assemblies being disposed in uneven confronting relation with said second one of said contact assemblies.

12. An alarm continuity switch as recited in claim 1 wherein said first wire terminal and said second wire terminal are disposed within a pair of generally tear drop shaped recesses in said contact housing so as to facilitate connection thereto.

13. An alarm continuity switch as recited in claim 1 wherein said first contact is pivotally biased in said vertical channel of said front main face of said contact housing.

14. An alarm continuity switch as recited in claim 7 including a third of said contact assemblies structured to be secured to the stationary frame edge of the closure frame in spaced apart relation from said second of said contact assemblies so as to slide into current flowing contact with said first of said contact assemblies upon the closure member being in the open position.

* * * * *